US009323187B2

(12) United States Patent
Kondo

(10) Patent No.: US 9,323,187 B2
(45) Date of Patent: Apr. 26, 2016

(54) FIXING DEVICE AND IMAGE FORMING APPARATUS

(71) Applicant: Brother Kogyo Kabushiki Kaisha, Nagoya-shi, Aichi-ken (JP)

(72) Inventor: Tomohiro Kondo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/667,186

(22) Filed: Mar. 24, 2015

(65) Prior Publication Data

US 2015/0277306 A1 Oct. 1, 2015

(30) Foreign Application Priority Data

Mar. 31, 2014 (JP) ..... 2014-071753

(51) Int. Cl.
*G03G 15/20* (2006.01)

(52) U.S. Cl.
CPC ..... *G03G 15/2039* (2013.01); *G03G 15/2078* (2013.01); *G03G 2215/2035* (2013.01)

(58) Field of Classification Search
CPC ..... G03G 15/2039; G03G 15/2078; G03G 2215/2016; G03G 2215/2035
USPC ..... 399/33, 69, 329; 219/216
See application file for complete search history.

(56) References Cited

U.S. PATENT DOCUMENTS

| | | | | |
|---|---|---|---|---|
| 7,224,255 | B2 * | 5/2007 | Uehara et al. | 337/297 |
| 8,391,761 | B2 * | 3/2013 | Mitsuoka et al. | 399/329 |
| 2007/0183798 | A1 * | 8/2007 | Moriguchi et al. | 399/33 |
| 2010/0178071 | A1 * | 7/2010 | Barton et al. | 399/69 |
| 2013/0034362 | A1 * | 2/2013 | Matsuura et al. | 399/69 |
| 2015/0117881 | A1 * | 4/2015 | Murakami | 399/33 |

FOREIGN PATENT DOCUMENTS

| | | | | |
|---|---|---|---|---|
| JP | H03264976 | A | | 11/1991 |
| JP | 2005099594 | A | * | 4/2005 |
| JP | 2010197676 | A | * | 9/2010 |
| JP | 2011197020 | A | * | 10/2011 |
| JP | 2012063412 | A | * | 3/2012 |

* cited by examiner

*Primary Examiner* — Robert Beatty
(74) *Attorney, Agent, or Firm* — Banner & Witcoff, Ltd.

(57) ABSTRACT

A fixing device includes an endless belt extending in a first direction and configured to rotate, a heater extending inside the endless belt in the first direction and configured to heat the endless belt, a first temperature sensor for detecting a temperature of the endless belt heated by the heater, the first temperature sensor being disposed inside the endless belt, a second temperature sensor for detecting a temperature of the endless belt heated by the heater, the second temperature sensor being disposed outside of the endless belt, and a thermal cutoff disposed outside of the endless belt and configured to interrupt electric current to the heater when the temperature of the endless belt exceeds a specified temperature.

12 Claims, 7 Drawing Sheets

FIXING DEVICE AND IMAGE FORMING APPARATUS

CROSS REFERENCE TO RELATED APPLICATION

This application claims priority from Japanese Patent Application No. 2014-071753, filed on Mar. 31, 2014, which is incorporated herein by reference in its entirety.

TECHNICAL FIELD

Aspects of the disclosure relate to a fixing device including a temperature sensor and an image forming apparatus including such a fixing device.

BACKGROUND

A known fixing device includes an endless belt, a heater disposed inside the endless belt, and a temperature sensor disposed inside the endless belt.

SUMMARY

When the temperature of the endless belt becomes too high, it affects components around the endless belt. Thus, it is preferable to provide a thermal cutoff that interrupts electric current to the endless belt when the temperature of the endless belt becomes too high. However, if the thermal cutoff is disposed inside the endless belt, space for the thermal cutoff inside the endless belt is needed. Thus, the diameter of the endless belt becomes great, causing the need to increase the physical size of the fixing device.

Illustrative aspects of the disclosure provide a fixing device including a thermal cutoff and in which the need to increase the physical size of the fixing device is reduced, and provide an image forming apparatus including the fixing device.

According to an aspect of the disclosure, a fixing device includes an endless belt extending in a first direction and configured to rotate, a heater extending inside the endless belt in the first direction and configured to heat the endless belt, a first temperature sensor for detecting a temperature of the endless belt heated by the heater, the first temperature sensor being disposed inside the endless belt, a second temperature sensor for detecting a temperature of the endless belt heated by the heater, the second temperature sensor being disposed outside of the endless belt, and a thermal cutoff disposed outside of the endless belt and configured to interrupt electric current to the heater when the temperature of the endless belt exceeds a specified temperature.

As the thermal cutoff is disposed outside of the endless belt, the need to increase a space inside of the endless belt is reduced, and thus the need to increase the physical size of the fixing device is reduced.

According to another aspect of the disclosure, an image forming apparatus includes a fixing device and a controller. The fixing device includes an endless belt extending in a first direction and configured to rotate, a heater extending inside the endless belt in the first direction and configured to heat the endless belt, a first temperature sensor disposed inside the endless belt and configured to output a first signal corresponding to a temperature of the endless belt heated by the heater, a second temperature sensor disposed outside of the endless belt and configured to output a second signal corresponding to a temperature of the endless belt heated by the heater, and a thermal cutoff disposed outside of the endless belt. The controller is configured to control a temperature of the heater based on the second signal from the second temperature sensor. The hernial cutoff is configured to interrupt electric current to the heater when the temperature of the endless belt exceeds a first temperature, which is higher than a fixing temperature. The controller determines whether a temperature of the endless belt obtained from the second temperature sensor is higher than a second temperature, which is higher than the fixing temperature and lower than the first temperature. When the controller determines that the temperature of the endless belt obtained from the second temperature sensor is higher than the second temperature, the controller is configured to reduce an output of the heater.

With this structure, an output of the heater can be reduced before the thermal cutoff operates.

BRIEF DESCRIPTION OF THE DRAWINGS

Reference is made to the following description taken in connection with the accompanying drawings, like reference numerals being used for like corresponding parts in the various drawings.

DETAILED DESCRIPTION

An embodiment of the disclosure will be described with reference to the following drawings. The following description will be first made to a general structure of a color laser printer 1 as an example of an image forming apparatus according to the embodiment of the disclosure.

In the following description, the expressions "front", "rear", "upper or top", "lower or bottom", "right", and "left" are used to define the various parts when the color laser printer 1 is disposed in an orientation in which it is intended to be used.

Figure 1:
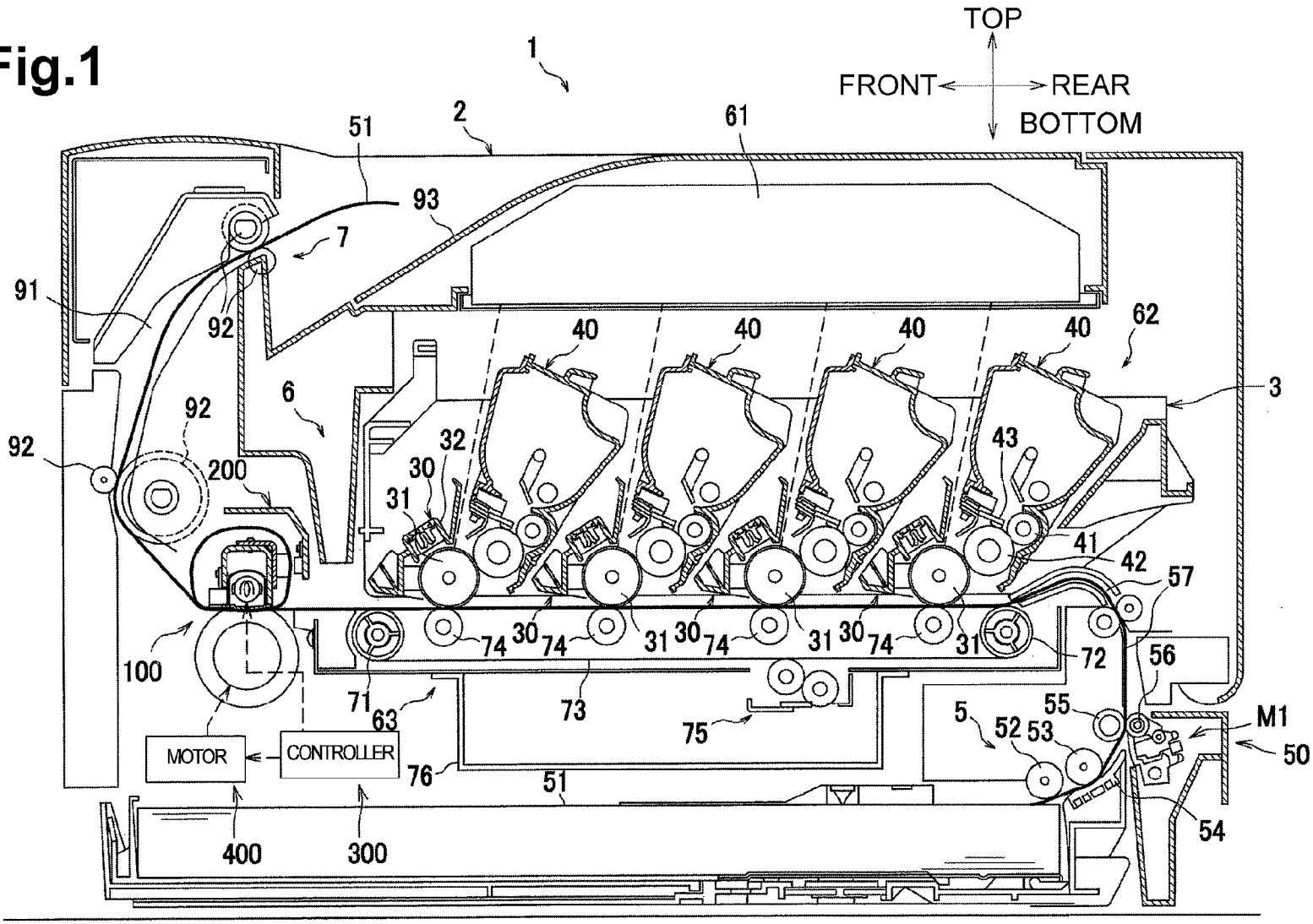
FIG. 1 is a sectional view of a color laser printer according to an illustrative embodiment.

As illustrated in FIG. 1, the color laser printer 1 includes, in a housing 2, a sheet feed portion 5 configured to feed a sheet 51, an image forming unit 6 configured to form an image on the sheet 51 fed by the sheet feed portion 5, an ejection portion 7 configured to eject the sheet 51 having the image formed thereon, a controller 300, and a motor 400.

The sheet feed portion 5 includes a sheet supply tray 50 disposed in a lower portion of the housing 2 and a sheet feed mechanism M1. The sheet supply tray 50 is configured to be slidably attached to and removed from the housing 2 from a front side thereof. The sheet feed mechanism M1 is configured to feed the sheet 51 from the sheet supply tray 50 by raising it from the front side and then reversing it rearward.

The sheet feed mechanism M1 includes a pickup roller 52, a separation roller 53, and a separation pad 54, which are disposed proximate to a front end portion of the sheet supply tray 50 and configured to feed sheets 51 one by one upward from the sheet supply tray 50. A sheet 51 being fed upward passes through between a dust removing roller 55 and a pinch roller 56 into a feed path 57, and the sheet 51 is directed rearward and supplied onto a conveyor belt 73, which will be described later. When the sheet 51 passes through between the dust removing roller 55 and the pinch roller 56, dust adhering to the sheet 51 is removed by the dust removing roller 55.

The image forming portion 6 includes a scanner portion 61, a process portion 62, a transfer portion 63, and a fixing device 100.

The scanner portion 61 is disposed in an upper portion of the housing 2, and includes laser emitting portions corresponding to cyan, magenta, yellow, and black, respectively, a polygon mirror, lenses and reflective mirrors, which are not illustrated. In the scanner unit 61, laser beams emitted from the respective laser emitting portions are directed to the polygon mirror rotating at high speed. The laser beams then pass through or are reflected by the lenses and the reflective mirrors, and scan surfaces of the respective photosensitive drums 31 in a left-right direction.

The process portion 62 is disposed below the scanner portion 61 and above the sheet feed portion 5, and includes a photosensitive member unit 3 configured to move in the front-rear direction relative to the housing 2. The photosensitive member unit 3 includes a plurality of, e.g., four, drum sub units 30 disposed in a lower portion of the photosensitive member unit 3, and a plurality of, e.g., four, developing cartridges 40 each detachably attached to a corresponding one of the drum sub units 30.

Each drum sub unit 30 includes a photosensitive drum 31 and a scorotron charger 32.

Each developing cartridge 40 contains toner inside, and includes a supply roller 41, a developing roller 42, and a layer-thickness regulating blade 43.

The process portion 62 functions as follows. Toner contained in each developing cartridge 40 is supplied to the developing roller 42 by rotation of the supply roller 41 and positively charged between the supply roller 41 and the developing roller 42 by friction. The toner supplied to the rotating developing roller 42 is scraped by the layer-thickness regulating blade 43 and carried on a surface of the developing roller 42 as a thin layer having a constant thickness.

In each drum sub unit 30, the scorotron charger 32 charges the photosensitive drum 31 uniformly and positively by corona discharge. The charged photosensitive drum 31 is irradiated by the laser light emitted from the scanner portion 61 so that an electrostatic latent image corresponding to an image to be formed on a sheet 51 is formed on the photosensitive drum 31.

When the photosensitive drum 31 further rotates, the toner carried on the developing roller 42 is supplied to the electrostatic latent image formed on the photosensitive drum 31, that is, exposed areas having low potential on the surface of the photosensitive drum 31. Thus, the electrostatic latent image becomes visible, and a toner image corresponding to each color toner is carried on the surface of the photosensitive drum 31.

The transfer unit 63 includes a drive roller 71, a driven roller 72, a conveyor belt 73, a plurality of transfer rollers 74 and a cleaning unit 75.

The drive roller 71 and the driven roller 72 are spaced apart parallel to each other in the front-rear direction. The conveyor belt 73, which is endless, is looped under tension around the drive roller 71 and the driven roller 72. An outer surface of the conveyor belt 73 contacts the photosensitive drums 31. The transfer rollers 74 are disposed within a loop of the conveyor belt 73 such that the transfer rollers 74 faces the respective photosensitive drums 31 via the conveyor belt 73. The transfer rollers 74 and the respective photosensitive drums 31 sandwich the conveyor belt 73 therebetween. The transfer rollers 74 each receive a transfer bias applied from a high-voltage board, not illustrated. During image formation, a sheet 51 conveyed by the conveyor belt 73 receives toner images on the respective photosensitive drums 31.

The cleaning unit 75 is disposed below the conveyor belt 73 and configured to remove waste toner adhered on the conveyor belt 73 and drop the removed waste toner to a waste toner storing portion 76 disposed below the cleaning unit 75.

The fixing device 100 is disposed behind the transfer unit 63 and configured to thermally fix the toner images transferred onto the sheet 51.

In the ejection portion 7, a sheet ejection path 91 extends upward to the front side from an outlet of the fixing device 100. A plurality of feed rollers 92 to feed the sheet 51 is disposed in the middle of the sheet ejection path 91. An upper surface of the housing 2 contains an ejection tray 93 to receive sheets 51 having images. Sheets 51 ejected from the sheet ejection path 91 by the feed rollers 92 are accumulated on the ejection tray 93.

The fixing device 100 will be described in detail.

Figure 2:
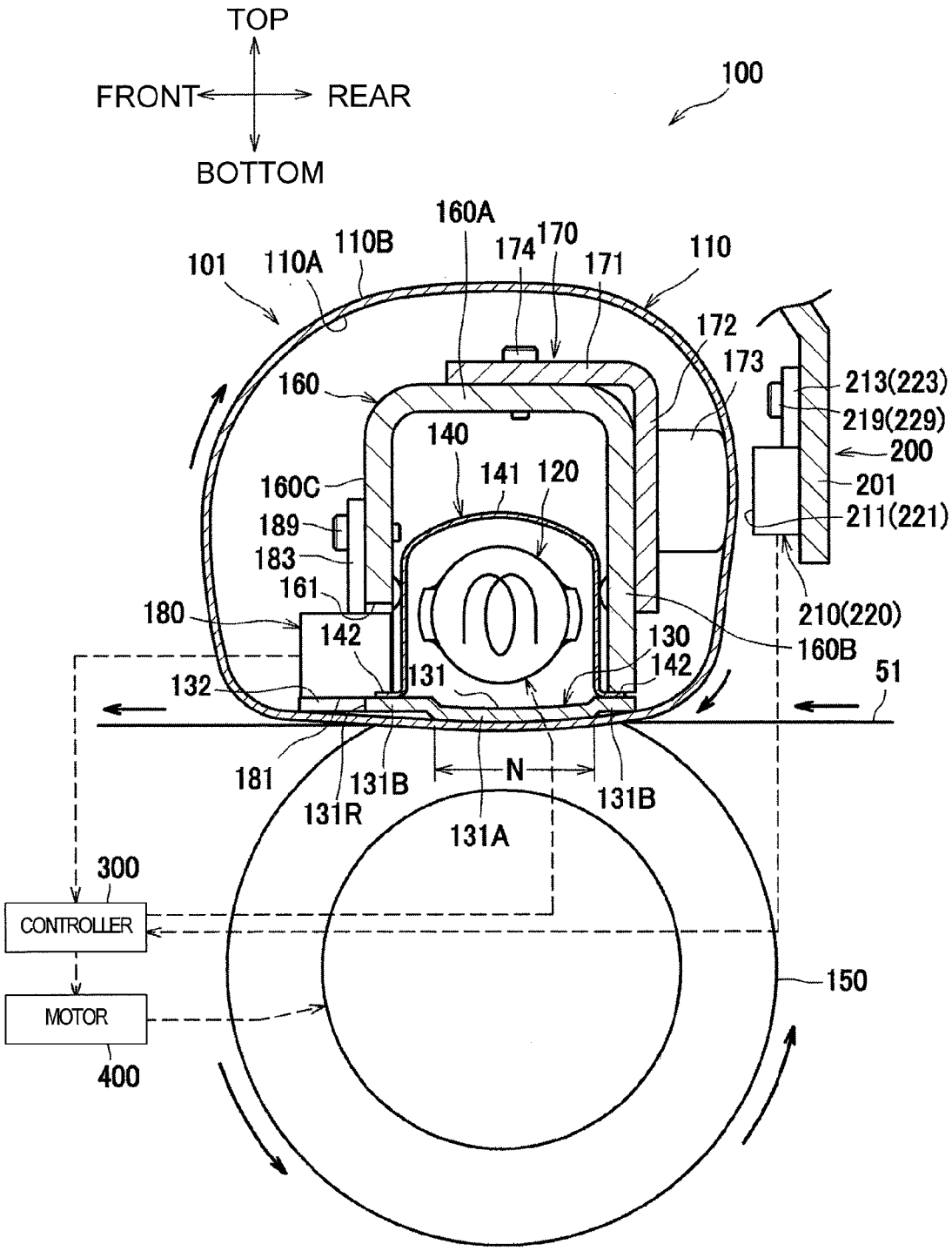
FIG. 2 is a sectional view of a fixing device.

As illustrated in FIG. 2, the fixing device 100 includes a heating member 101, a pressure roller 150 as an example of a backup member, a fixing device frame 200 as an example of a frame, a second thermistor 210 as an example of a second temperature sensor, and a thermostat 220 as an example of a thermal cutoff.

The heating member 101 includes a fixing belt 110 as an example of an endless belt, a halogen lamp 120 as an example of a heater, a nip plate 130, a reflective plate 140, a stay 160, a covering member 170, and a first thermistor 180 as an example of a first temperature sensor.

The fixing belt 110 is an endless belt having heat resistance and flexibility, and configured to rotate in contact with the pressure roller 150 and rearward at a nip N. The fixing belt 110 is configured to rotate around an axis extending in the left-right direction, and has an inner cylindrical surface 110A to slidingly contact the nip plate 130 and an outer cylindrical surface 110B to slidingly contact the pressure roller 150.

The fixing belt 110 has a metal tube made of metal such as stainless steel. The fixing belt 110 has a rubber layer on the surface of the metal tube. The fixing belt 110 may further have a non-metal protective layer, e.g. a fluorine coated layer, on the rubber layer.

The halogen lamp 120 is a heater to configured to generate heat and is provided separately from the nip plate 130. The halogen lamp 120 is configured to heat toner on a sheet 51 by giving off radiant heat to heat the nip plate 130 and the fixing belt 110. The halogen lamp 120 extends in the left-right direction inside the fixing belt 110 and is disposed at a specified distance from the fixing belt 110 and an inner surface of the nip plate 130.

The nip plate 130 is shaped like a plate receiving the radiant heat from the halogen lamp 120 and contacts the inner cylindrical surface 110A of the fixing belt 110. The nip plate 130 transmits the radiant heat received from the halogen lamp 120 to toner on the sheet 51 via the fixing belt 110. The nip plate 130 is made of metal and formed by bending a material, e.g., an aluminum plate, having higher thermal conductivity than the steel stay 160. The nip plate 130 includes a base portion 131 and a protruding portion 132.

The base portion 131 is shaped such that its central portion 131A protrudes toward the pressure roller 150 further than both end portions 131B.

Figure 3:
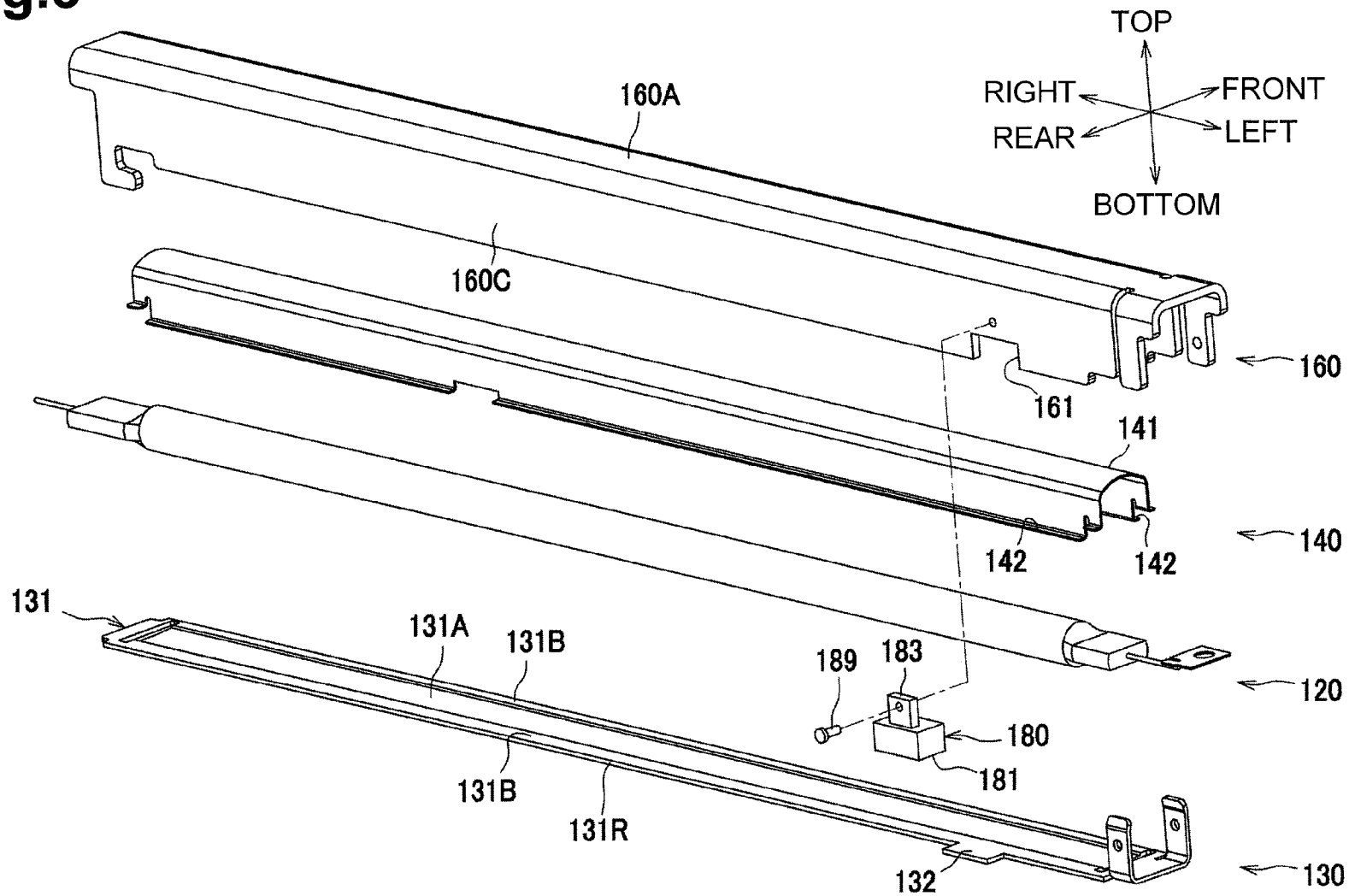
FIG. 3 is an exploded perspective view illustrating a halogen lamp, a nip plate, a reflective plate, a stay, and a first thermistor.

The protruding portion 132 protrudes from a rear end portion 131R of the base portion 131 along a sheet feed direction. As illustrated in FIG. 3, the protruding portion 132 is formed at a left end portion of the rear end portion 131R of the base portion 131.

As illustrated in FIG. 2, the reflective plate 140 is configured to reflect the radiant heat (emitted mainly in the front-rear direction and upward) from the halogen lamp 120 toward the nip plate 130 (or an inner surface of the base portion 131).

The reflective plate 140 is disposed surrounding the halogen lamp 120 at a specified distance from the halogen lamp 120 inside the fixing belt 110.

The radiant heat from the halogen lamp 120 is efficiently collected onto the nip plate 130 by the reflective plate 140, which can promptly heat the nip plate 130 and the fixing belt 110.

The reflective plate 140 is formed by bending, in a substantially U-shape in cross section, a material, e.g., an aluminum plate, having high infrared and far-infrared reflectance and high thermal conductivity. Specifically, the reflective plate 140 includes a reflective portion 141 having a curved shape, e.g., a substantially U-shape in cross section, and flange portions 142 extending outward in the front-rear direction from respective lower ends of the reflective portion 141. The reflective plate 140 may be formed with an aluminum plate polished to a mirror-smooth state to increase heat reflectance.

The stay 160 secures stiffness of the nip plate 130 by supporting both end portions 131B of the base portion 131 of the nip plate 130 in the front-rear direction via the flange portions 142. The stay 160 is disposed surrounding the reflective plate 140. Specifically, the stay 160 includes an upper wall 160A, a front wall 160B extending downward from a front end of the upper wall 160A, and a rear wall 160C extending downward from a rear end of the upper wall 160A, such that it is shaped like a letter U in cross section.

As illustrated in FIG. 3, the rear wall 160C of the stay 160 has a notch 161 for arranging the first thermistor 180. Specifically, the notch 161 is shaped at a position corresponding to the protruding portion 132 of the nip plate 130 such that the first thermistor 180 is arranged in the notch 132 with a slight clearance from the notch 132.

Figure 4A:
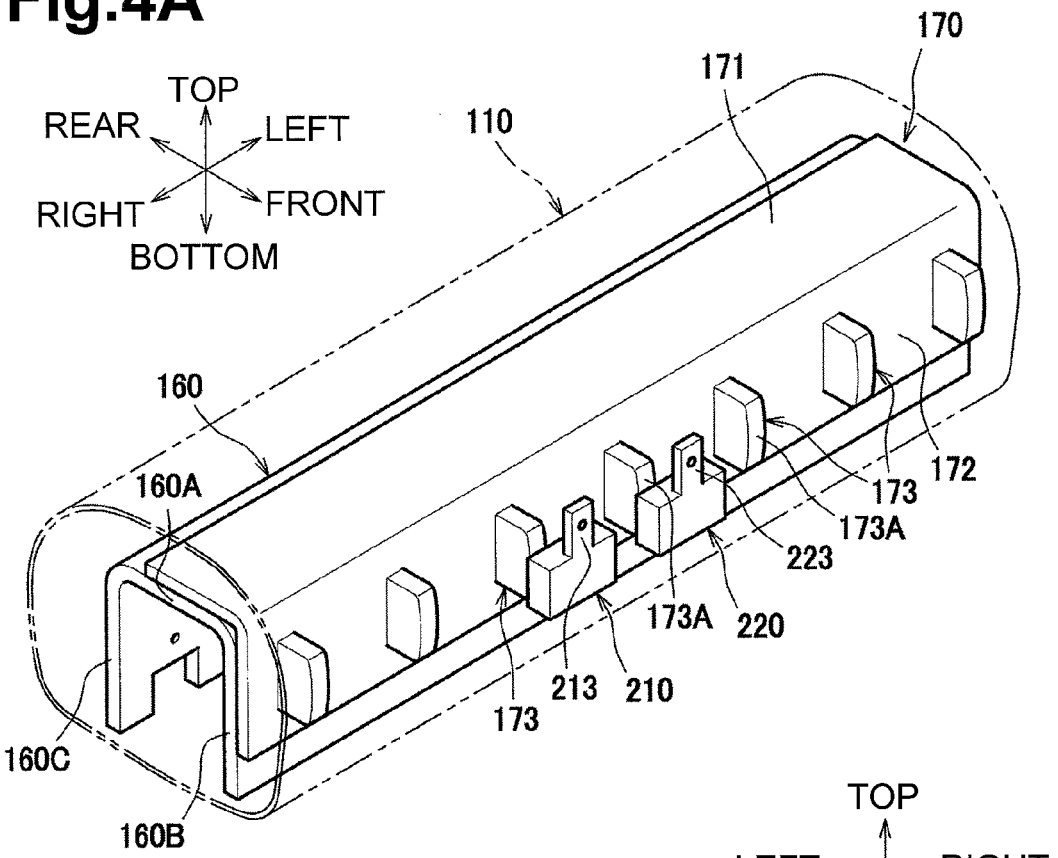
FIG. 4A is a perspective view illustrating the stay, a covering member, a second thermistor, and a thermostat.
Figure 4B:
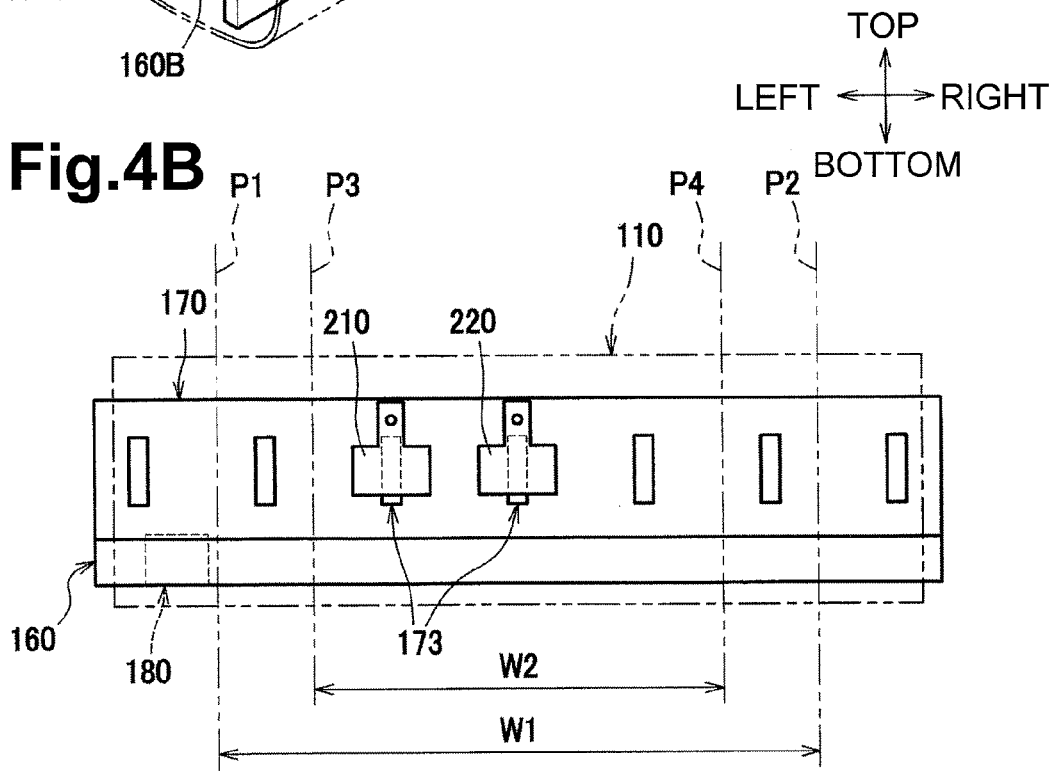
FIG. 4B is a front view illustrating the stay, the covering member, the second thermistor, and the thermostat.

As illustrated in FIGS. 4A and 4B, the covering member 170 is disposed covering the upper wall 160A and the front wall 160B of the stay 160, and includes an upper wall 171 and a front wall 172 extending downward from a front end of the upper wall 171. A front surface of the front wall 172 is provided with a plurality of ribs 173.

There are seven ribs 173 spaced in the left-right direction and protruding to the front from the front surface of the front wall 172. Each of the ribs 173 is substantially rectangular shaped, and has a front surface as a guide surface 173A configured to guide the inner cylindrical surface 110A of the fixing belt 110. A middle rib 173 and its adjacent rib 173 positioned to the left face the thermostat 220 and the second thermistor 210, respectively, via the fixing belt 110.

As illustrated in FIGS. 2 and 3, the first thermistor 180 is a contact thermistor and disposed such that it detects the temperature of the nip plate 130. In other words, the first thermistor 180 is configured to detect the temperature of the fixing belt 110 via the nip plate 130.

Specifically, a fixing rib 183 provided in an upper portion of the first thermistor 180 is fixed to a left end portion of the rear wall 160C of the stay 160 with a screw 189 in the inside of the fixing belt 110.

As illustrated in FIG. 4B, the first thermistor 180 is disposed closer to an exterior of the fixing device 100 than a left end of a sheet 51 having a maximum width W1 in the left-right direction (or in a width direction of the fixing belt 110). In other words, the first thermistor 180 is disposed to the left of a first plane P1 including the left end of the sheet 51 having the maximum width W1 and extending perpendicular to the left-right direction (the width direction of the fixing belt 110).

The maximum width W1 of a sheet 51 refers to a maximum width of a sheet on which the fixing device 100 is configured to fix an image, and which can be set by a driver of the color laser printer 1 or set by a restriction member that restricts the position of an end of a sheet 51 the sheet supply tray 50 can receive inside. The maximum with W1 may be 210 mm (for a width of A4 sheet) or 215.9 mm (for a width of legal-sized sheet).

The first thermistor 180 may be disposed to the right of a second plane P2 including a right end of the sheet 51 having the maximum width W1 and extending perpendicularly to the left-right direction (the width direction of the fixing belt 110).

The first thermistor 180 is disposed such that a temperature detection surface 181 of the first thermistor 180 is in contact with an upper surface of the protruding portion 132. The first thermistor 180 may be a non-contact thermistor spaced from the nip plate 130 or an infrared sensor.

As illustrated in FIG. 2, the pressure roller 150 is disposed in contact with the outer cylindrical surface 110B of the fixing belt 110 and forms a nip N between the pressure roller 150 and the fixing belt 110. The pressure roller 150 is disposed below the nip plate 130 such that the pressure roller 150 and the nip plate 130 sandwich the fixing belt 110 therebetween.

The fixing device frame 200 is disposed covering upper and front portions of the fixing belt 110 of the heating member 101. The second thermistor 210 and the thermostat 220 are disposed on an inner surface of a front wall 201 disposed in front of the heating member 101. It is noted that, in FIG. 2, the numeral 220 representing the thermostat is in parentheses for convenience sake as the thermostat 220 is disposed behind the second thermistor 210.

The second thermistor 210 is a non-contact thermistor disposed outside of the fixing belt 110. A fixing rib 213 provided in an upper portion of the second thermistor 210 is fixed to the front wall 201 of the fixing device frame 200 with a screw 219. The second thermistor 210 is disposed such that a temperature detection surface 211, which is provided on a rear surface of the second thermistor 210, faces the outer cylindrical surface 110B of the fixing belt 110 of the fixing belt 110 with a slight clearance (in which the temperature can be detected).

Specifically, the second thermistor 210 is disposed such that the temperature detection surface 211 is further to the front than the nip N or upstream from the nip N in a rotation direction of the fixing belt 110.

As illustrated in FIGS. 4A and 4B, the second thermistor 210 is disposed closer to an interior of the fixing device 100 than a left end of a sheet 51 having a minimum width W2 in the left-right direction. The minimum width W2 of a sheet 51 refers to a minimum width of a sheet on which the fixing device 100 is configured to fix an image, and which can be set by a driver of the color laser printer 1 or set by a restriction member that restricts the position of an end of a sheet 51 the sheet supply tray 50 can receive inside.

The minimum width W2 may be 69.9 mm (for a width of Organizer J), 76.0 mm (for a width of Monarch), 100 mm (for a width of postcard), 81 mm (for a width of C7), or 105 mm (for a width of A6).

The second thermistor 210 may be a contact thermistor contacting the fixing belt 110 or an infrared sensor. The second thermistor 210 and the first thermistor 180 may generate an analog value with temperature or generate a digital value based on an analog value. The analog or digital value is transmitted to a controller 300 as a signal.

The thermostat 220 is a temperature detection device formed with bimetal. As illustrated in FIG. 2, the thermostat 220 is disposed outside of the fixing belt 110 and a fixing rib 223 provided in an upper portion of the thermostat 220 is fixed to the front wall 201 of the fixing device frame 200 with a screw 229. The thermostat 220 is disposed such that a temperature detection surface 221, which is provided on a rear surface of the thermostat 220, faces the outer cylindrical surface 110B of the fixing belt 110 with a slight clearance (in which the temperature can be detected).

Specifically, the thermostat 220 is disposed such that the temperature detection surface 221 is further to the front than the nip N or upstream from the nip N in the rotation direction of the fixing belt 110.

As illustrated in FIGS. 4A and 4B, the thermostat 220 is disposed closer to an interior of the fixing device 100 than a left end of a sheet 51 having a minimum width W2 in the left-right direction. In other words, the second thermistor 210 and the thermostat 220 are disposed between a third plane P3 and a fourth plane P4. The third plane P3 includes the left end of the sheet having the minimum width W2 and extends perpendicularly to the left-right direction (the width direction of the fixing belt 110). The fourth plane P4 includes the right end of the sheet 51 having the minimum width W2 and extends perpendicularly to the left-right direction (the width direction of the fixing belt 110). The second thermistor 210 and the thermostat 220 may be disposed within an area corresponding to the sheet 51 having the maximum width W1.

The thermostat 220 is disposed on a circuit for supplying electricity to the halogen lamp 120 and configured to interrupt the electric current to the halogen lamp 120 when a temperature of the fixing belt 110 exceeds a first temperature greater than a fixing temperature. This prevents excessive rise in temperature of the fixing device 100. The fixing temperature refers to a temperature within a range in which an image can be fixed favorably on a sheet 51. The fixing temperature can be adjusted appropriately for experiments and simulations. In this embodiment, the fixing temperature is 180 degrees Celsius. The fixing temperature may range between 160 degrees Celsius and 240 degrees Celsius or between 175 degrees Celsius and 270 degrees Celsius in accordance with characteristics of the fixing device 100. In the embodiment, the first temperature is 270 degrees Celsius. The first temperature may range between 200 degrees Celsius and 290 degrees Celsius in accordance with characteristics of the fixing device 100.

Figure 5A:
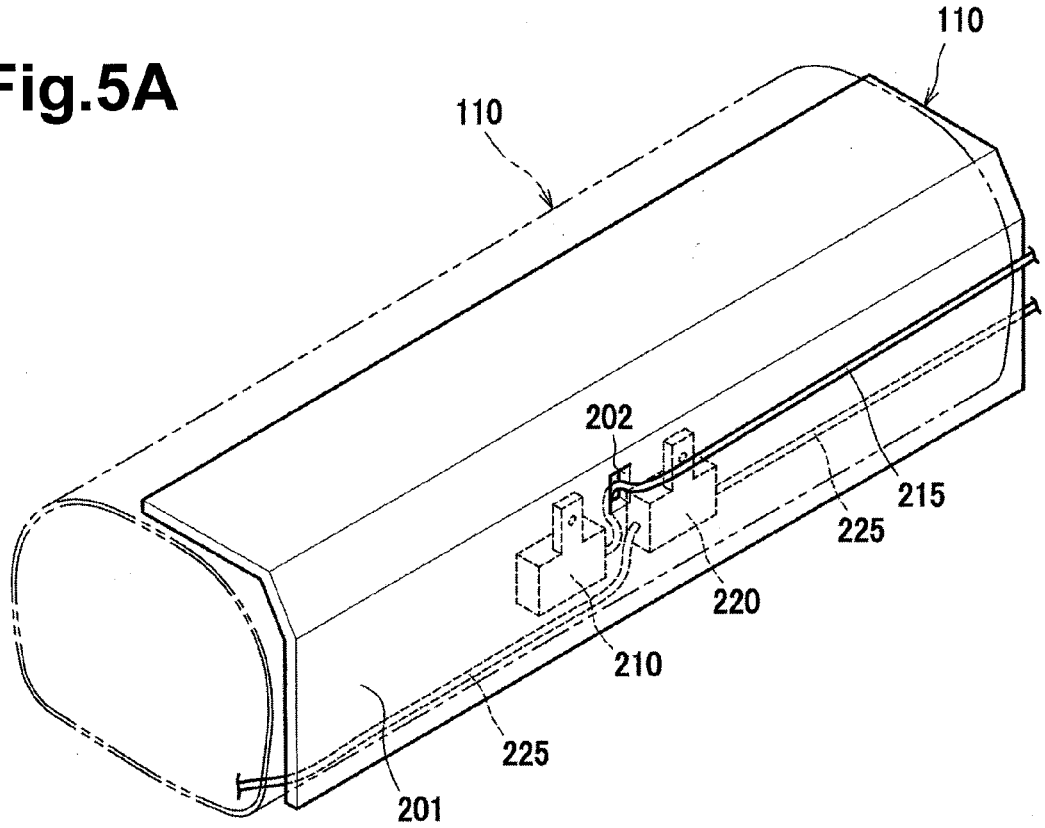
FIG. 5A is a perspective view of a fixing device frame.
Figure 5B:
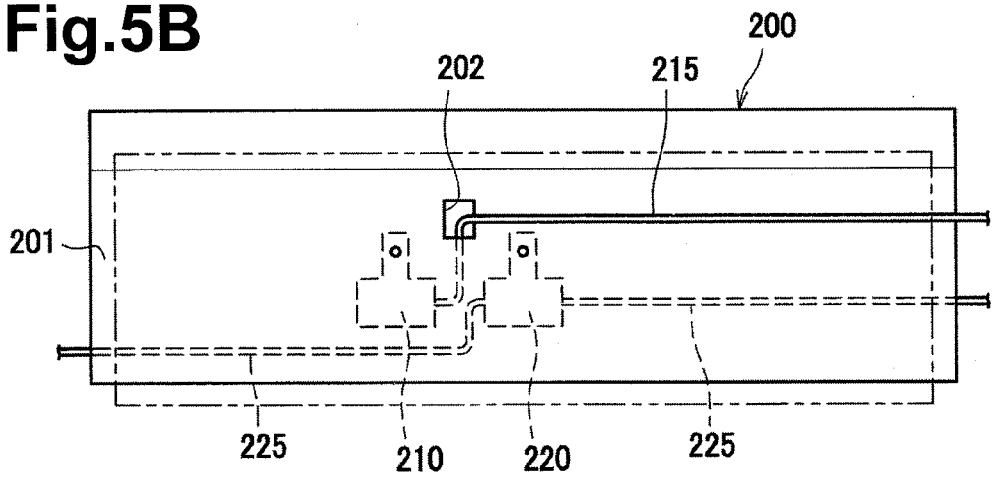
FIG. 5B is a front view of the fixing device frame.

As illustrated in FIGS. 5A and 5B, first wires 225 are connected to the thermostat 220. The first wires 225 are connected to a terminal of the halogen lamp 120 and a power circuit board. The first wires 225 are connected to left and right ends of the thermostat 220, respectively. The first wires 225 are routed on the inner surface of the front wall 201 of the fixing device frame 200. The left first wire 225 is routed below the second thermistor 210. The fixing device frame 200 protects the first wires 225.

A second wire 215 is connected to the second thermistor 210. The second wire 215 is connected to the controller 300. The second wire 215 passes through an opening 202 of the front wall 201 of the fixing device frame 200, extending to the exterior of the fixing device frame 200 such that the second wire 215 is routed on the outer surface of the fixing device frame 200. The first wires 225 and the second wire 215 are prevented from contacting each other and insulated by the fixing device frame 200.

The controller 300 will be described.

The controller 300 includes a central processing unit or CPU, a random access memory or RAM, a read only memory or ROM. The controller 300 controls the halogen lamp 120 and the motor 400 by calculating based on signals from the first thermistor 180 and the second thermistor 210 and preset programs. The signals may be replaced with temperatures themselves the first thermistor 180 and the second thermistor 210 obtain. The ROM stores commands to perform various control operations as programs. The CPU performs the control operations by reading a command from the ROM.

The controller 300 controls the halogen lamp 120 based on a signal from the second thermistor 210. Specifically, the controller 300 controls to maintain the output of the halogen lamp 120 constant until a temperature of the fixing belt 110 obtained from the second thermistor 210 reaches the fixing temperature. After the temperature of the fixing belt 110 has reached the fixing temperature, the controller 300 performs basic operation to control the halogen lamp 120 such that the temperature of the fixing belt 110 is maintained at the fixing temperature.

The controller 300 determines whether the temperature obtained from the second thermistor 210 is higher than the fixing temperature and higher than a second temperature, which is lower than the first temperature. The second temperature is higher than the fixing temperature, but at which the thermostat 220 does not interrupt the electric current to the halogen lamp 120. The second temperature can be adjusted appropriately for experiments and simulations. In the embodiment, the second temperature may range between 170 degrees Celsius and 250 degrees Celsius in accordance with characteristics of the fixing device 100.

The controller 300 reduces the output of the halogen lamp 120 when the temperature obtained from the second thermistor 210 is higher than the second temperature. This control allows the reduction of the output of the halogen lamp 120 before the thermostat 220 operates.

The controller 300 can perform an auxiliary control that controls the halogen lamp 120 based on a signal from the first thermistor 180. Specifically, the controller 300 performs a control for increasing the output of the halogen lamp 120 to a value higher than the current value when a difference between a temperature detected by the first thermistor 180 and a temperature detected by the second thermistor 210 is greater than a specified threshold value A. The threshold value A may be appropriately determined based on experiments and simulations.

Figure 6:
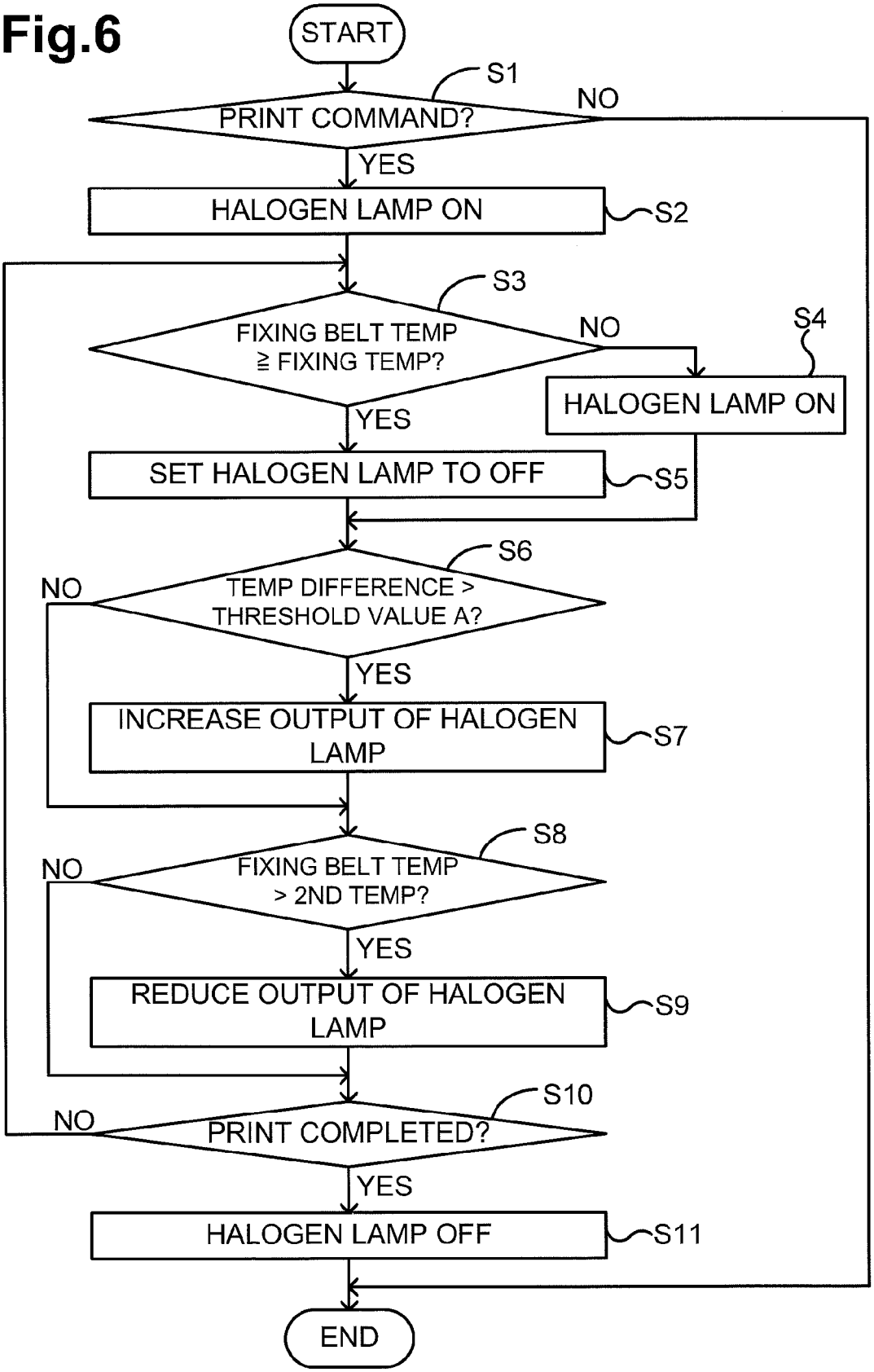
FIG. 6 is a flowchart showing operations of a controller.

The controller 300 structured above performs control in accordance with flowchart illustrated in FIG. 6. As illustrated in FIG. 6, the controller 300 determines whether there is a print command at S1. When it determines no print command at S1 (No), the controller 300 ends the control.

When determining that there is a print command at S1 (Yes), the controller 300 sets the halogen lamp 120 to an ON state (S2). After S2, the controller 300 determines whether the temperature of the fixing belt 110 detected by the second thermistor 210 is greater than or equal to the fixing temperature (S3).

When the controller 300 determines that the temperature of the fixing belt 110 is under the fixing temperature at S3 (No), it sets the halogen lamp 120 to the ON state (S4). Specifically, at S4, when the halogen lamp 120 is already in the ON state, the controller 300 maintains the halogen lamp 120 at the ON state, and when the halogen lamp 120 is in an OFF state, the controller 300 sets the halogen lamp 120 to the ON state.

When the controller 300 determines that the temperature of the fixing belt 110 is greater than or equal to the fixing temperature at S3 (Yes), it sets the halogen lamp 120 to the OFF state (S5). After S4 and S5, the controller 300 determines whether a temperature difference between the first thermistor 180 and the second thermistor 210 is greater than the threshold value A (S6).

When the controller 300 determines that the temperature difference is greater than the threshold value A at S6 (Yes), it increases the output of the halogen lamp 120 to a value higher than the threshold value A (S7). After S7 or when the controller 300 determines No at S6, the controller 300 determines whether the temperature of the fixing belt 110 detected at the second thermistor 210 is greater than the second temperature (S8).

When the controller 300 determines that the temperature of the fixing belt 110 is greater than the second temperature at S8 (S8: Yes), it reduces the output of the halogen lamp 120 (S9).

After S9 or when the controller 30 determines No at S8, the controller 300 determines whether a print control is completed (S10). When the controller 300 determines that the print control is not completed at S10 (No), it returns to S3. When the controller 300 determines that the print control is completed at S10 (Yes), it sets the halogen lamp 120 to the OFF state (S11), and ends the control.

Advantageous effects of the color laser printer 1 structured above will be described.

As the thermostat 220 is provided outside of the fixing belt 110, the need to increase a space inside of the fixing belt 110 is reduced, and thus the need to increase the physical size of the fixing device 100 is reduced.

The first thermistor 180 detects the temperature of the fixing belt 110 at an end portion of the inner cylindrical surface 110A and the second thermistor 210 detects the temperature of the fixing belt 110 within an area corresponding to a sheet 51 having a minimum width which is an image fixing portion of the fixing belt 110.

As the fixing belt 110 has the rubber layer on the surface thereof, the temperature difference between inside and outside of the fixing belt 110 may become great. In this embodiment, however, using the first thermistor 180 and the second thermistor 210, controls are made with consideration given to the temperature difference between inside and outside of the fixing belt 110.

A front portion of the fixing belt 110 relative to the nip N (or an upstream portion of the fixing belt 110 relative to the nip N in the rotation direction) is becomes under tension by being drawn into the nip N. In the embodiment, the front or upstream portion, which is tensed, of the fixing belt 110 relative to the nip N faces the thermostat 220. As a distance between the second thermistor 210 and the tensed portion of the fixing belt 110 is unchanged, the temperature at the tensed portion of the fixing belt 110 can be preferably detected.

Figure 7:
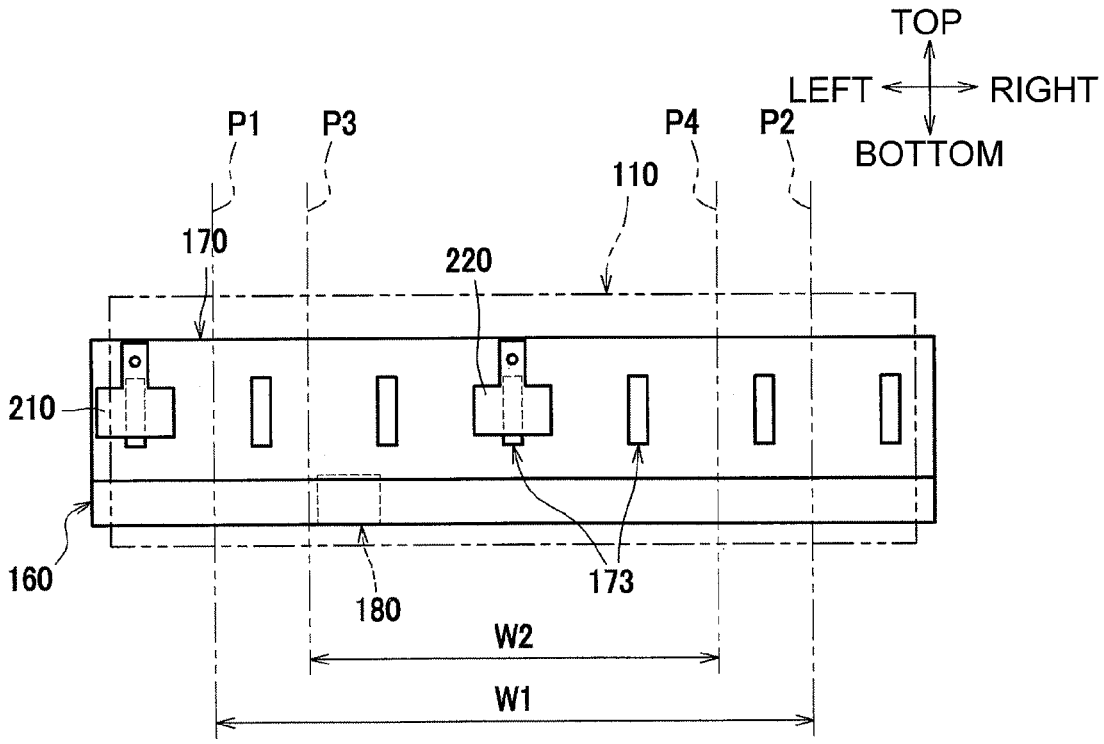
FIG. 7 is a front view of a modification corresponding to an embodiment illustrated in FIG. 4B.

The above embodiment shows, but is not limited to, the first thermistor 180 being disposed outside of an area corresponding to the maximum width W1 of the sheet and the second thermistor 210 being disposed within an area corresponding to the minimum width W2 of the sheet. For example, as illustrated in FIG. 7, the first thermistor 180 may be disposed within the area corresponding to the minimum width W2 of the sheet and the second thermistor 210 may be disposed outside of the area corresponding to the maximum width W1 of the sheet.

As heat is less likely to escape from end portions of the outer cylindrical surface 110B of the fixing belt 110, which are outside of the area corresponding to the maximum width W1 of the sheet, the temperature at the end portions of the outer cylindrical surface 110B of the fixing belt 110 should be prevented from rising excessively. In the modification illustrated in FIG. 7, the temperature at a portion of the fixing belt 110 disposed within the area corresponding to the minimum width W2 of the sheet is detected while the temperature at the end portions of the outer cylindrical surface 110B of the fixing belt 110 is detected. The first thermistor 180 may be disposed within the area corresponding to the maximum width W1 of the sheet.

The above embodiment shows, but is not limited to, the fixing belt 110 having the rubber layer.

The above embodiment shows, but is not limited to, the first wires 225 being routed on the inner surface of the fixing device frame 200 and the second wire 215 being routed on the outer surface of the fixing device frame 200. The first wires 225 may be routed on the outer surface of the fixing device frame 200 and the second wire 215 may be routed on the inner surface of the fixing device frame 200.

The above embodiment shows, but is not limited to, the halogen lamp 120 as an example of a heater. The heater may include a ceramic heater or a carbon heater, for example.

The above embodiment shows, but is not limited to the thermostat 220 as an example of a thermal cutoff. The thermal cutoff may be replaced with a fuse.

The above embodiment shows, but is not limited to the pressure roller 150 as an example of a backup member. The backup member may include a belt-shaped member.

The above embodiment shows, but is not limited to, the fixing belt 110 as a metal-made belt. The fixing belt may include a resin film mainly composed of polyimide. In this case, the fixing belt may have an outer layer made of fluorine resin such as polytetrafluoroethylene.

The above embodiment shows, but is not limited to, the color laser printer 1 to which the disclosure is applied. The disclosure may be applied to other image forming apparatuses, such as, a copier and a multifunction apparatus.

The above embodiment shows, but is not limited to, the controller 300 having a single CPU to perform operations illustrated in FIG. 6. For example, the controller may have a plurality of CPUs to perform operations illustrated in FIG. 6. Alternatively, the controller may have hardware circuitry such as ASIC (application specific integrated circuit). Further alternatively, the controller may have a CPU and hardware circuitry to perform the operation illustrated in FIG. 6.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. A fixing device configured to thermally fix an image on a sheet, the fixing device comprising:

an endless belt extending in a first direction and configured to rotate;

a heater extending inside the endless belt in the first direction and configured to heat the endless belt;

a nip plate extending inside the endless belt in the first direction and configured to receive heat from the heater and transmit the heat to the endless belt;

a first temperature sensor for detecting a temperature of the nip plate heated by the heater and outputting a first signal of the temperature of the nip plate, the first temperature sensor being disposed inside the endless belt;

a second temperature sensor for detecting a temperature of the endless belt heated by the heater and outputting a second signal of the temperature of the endless belt, the second temperature sensor being disposed outside of the endless belt;

a thermal cutoff disposed outside of the endless belt and configured to interrupt electric current to the heater when the temperature of the endless belt exceeds a specified temperature; and a controller configured to control a temperature of the heater based on the first signal of the temperature of the nip plate from the first temperature sensor and the second signal of the temperature of the endless belt from the second temperature sensor.

2. The fixing device according to claim 1, wherein the first temperature sensor is disposed outside of an area corresponding to a sheet having a maximum width on which the fixing device is configured to form an image, and wherein the second temperature sensor is disposed within the area.

3. The fixing device according to claim 1, wherein the first temperature sensor is disposed within an area corresponding to a sheet having a minimum width on which the fixing device is configured to form an image, and wherein the second temperature sensor is disposed outside of the area.

4. The fixing device according to claim 1, wherein the endless belt has a rubber layer.

5. The fixing device according to claim 1, further comprising a backup member extending in the first direction and facing an outer cylindrical surface of the endless belt such that the backup member and the endless belt form a nip therebetween, wherein the thermal cutoff and the second temperature sensor are disposed upstream of the nip in a sheet conveyance direction in which a sheet is conveyed through the nip and the first temperature sensor is disposed downstream of the nip in the sheet conveyance direction.

6. The fixing device according to claim 1, further comprising:

a frame extending in the first direction and facing an outer cylindrical surface of the endless belt;

a first wire connected to the thermal cutoff; and a second wire connected to the second temperature sensor, wherein the thermal cutoff and the second temperature sensor are disposed on an inner surface of the frame, the inner surface facing the outer cylindrical surface of the endless belt, and wherein one of the first wire and the second wire is routed on the inner surface of the frame and the other one of the first wire and the second wire passes through an opening in the frame and extends from an interior of the frame to an exterior of the frame.

7. The fixing device according to claim 1, further comprising a covering member extending inside the endless belt in the first direction and having a first rib, the first rib being configured to guide an inner cylindrical surface of the endless belt, wherein the first rib is disposed facing the second temperature sensor via the endless belt.

8. The fixing device according to claim 7, wherein the covering member has a second rib configured to guide the inner cylindrical surface of the endless belt, the second rib being disposed facing the thermal cutoff via the endless belt.

9. The fixing device according to claim 1, wherein the first temperature sensor is disposed on the nip plate.

10. The fixing device according to claim 1, wherein the second temperature sensor faces the endless belt with a clearance.

11. An image forming apparatus comprising:

an image forming unit configured to form an image on a sheet; and a fixing device configured to fix the image on the sheet, the fixing device including:

an endless belt extending in a first direction and configured to rotate;

a heater extending inside the endless belt in the first direction and configured to heat the endless belt;

a nip plate extending inside the endless belt in the first direction and configured to receive heat from the heater and transmit the heat to the endless belt;

a first temperature sensor disposed inside the endless belt and configured to output a first signal of a temperature of the nip plate heated by the heater;

a second temperature sensor disposed outside of the endless belt and configured to output a second signal of a temperature of the endless belt heated by the heater;

a thermal cutoff disposed outside of the endless belt; and a controller configured to control a temperature of the heater based on the first signal of the temperature of the nip plate from the first temperature sensor and the second signal of the temperature of the endless belt from the second temperature sensor, wherein the thermal cutoff is configured to interrupt electric current to the heater when the temperature of the endless belt exceeds a first temperature, which is higher than a fixing temperature, wherein the controller determines whether a temperature of the endless belt obtained from the second temperature sensor is higher than a second temperature, which is higher than the fixing temperature and lower than the first temperature, wherein, when the controller determines that the temperature of the endless belt obtained from the second temperature sensor is higher than the second temperature, the controller is configured to reduce an output of the heater.

12. The image forming apparatus according to claim 11, wherein the first temperature sensor is disposed on the nip plate.

* * * * *